US005328629A

United States Patent [19]

Crudden

[11] Patent Number: 5,328,629

[45] Date of Patent: Jul. 12, 1994

[54] PROCESS FOR PRODUCING A SYNTHETIC DETERGENT SOAP BASE FROM N-ACYL SARCOSINE

[75] Inventor: Joseph J. Crudden, Hudson, N.H.

[73] Assignee: Hampshire Chemical Corp., Lexington, Mass.

[21] Appl. No.: 906,004

[22] Filed: Jun. 26, 1992

Related U.S. Application Data

[63] Continuation of Ser. No. 670,800, Mar. 18, 1991, abandoned.

[51] Int. Cl.[5] ..... C11D 1/04; C11D 1/10; C11D 9/30; C11D 13/00

[52] U.S. Cl. ..... 252/117; 252/546; 252/DIG. 16

[58] Field of Search ..... 252/117, 546, DIG. 16

[56] References Cited

U.S. PATENT DOCUMENTS

| | | | |
|---|---|---|---|
| 2,830,064 | 4/1958 | Monick | 252/546 |
| 3,879,309 | 4/1975 | Gatti et al. | 252/117 |
| 4,092,259 | 5/1978 | Prince | 252/117 |
| 4,326,978 | 4/1982 | Moesch | 252/107 |
| 4,673,525 | 6/1987 | Small et al. | 252/132 |
| 4,754,874 | 7/1988 | Haney | 252/90 |
| 4,758,370 | 7/1988 | Jungermann et al. | 252/132 |
| 4,812,253 | 3/1989 | Small et al. | 252/132 |
| 4,919,838 | 4/1990 | Tibbetts et al. | 252/117 |
| 4,954,282 | 9/1990 | Rys et al. | 252/117 |

FOREIGN PATENT DOCUMENTS

| | | |
|---|---|---|
| 0308189 | 3/1989 | European Pat. Off. . |
| 0308190 | 3/1989 | European Pat. Off. . |
| 63-2962 | 1/1988 | Japan . |
| 1197672 | 7/1970 | United Kingdom . |

*Primary Examiner*—Paul Lieberman
*Assistant Examiner*—E. M. Higgins
*Attorney, Agent, or Firm*—Nields & Lemack

[57] ABSTRACT

A method of producing a synthetic detergent soap base, comprising dissolving in an n-acyl sarcosine at an elevated temperature a fatty acid, and neutralizing the mixture with a base at a temperature sufficient to maintain fluidity to a pH of from about 4.5 to about 9.5. The resulting product is non-irritating and non-drying, and exhibits apparent skin substantivity and pleasant skin feel.

7 Claims, No Drawings

PROCESS FOR PRODUCING A SYNTHETIC DETERGENT SOAP BASE FROM N-ACYL SARCOSINE

This is a continuation of co-pending application Ser. No. 07/670,800 filed on Mar. 18, 1991, now abandoned.

BACKGROUND OF THE INVENTION

1. Field of the Invention

This invention relates to a process of making a synthetic detergent soap base from N-acyl sarcosine.

2. Description of the Prior Art

The use of sarcosinate surfactants, and in particular, N-acyl sarcosinates in the manufacture of soap is well known. Typically, the sarcosinate is used in the form of its sodium, potassium or ammonium salt solution. N-acyl sarcosinates are produced commercially by the Schotten-Baumann reaction of the sodium salt of sarcosine with the appropriate fatty acid chloride under carefully controlled conditions:

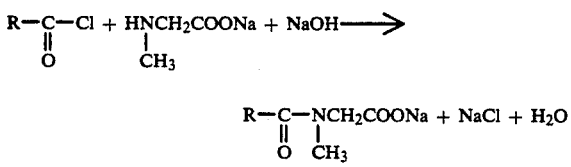

where R is typically a fatty acid of chain length $C^{10}$ to $C^{18}$ commonly made from lauric, coconut, palmitic, myristic or oleic acid. After the reaction is complete, the crude sodium salt is acidified to liberate the free fatty sarcosinic acid which is separated from the aqueous by-products. It then is neutralized to a salt form. Sarcosinates such as sodium lauroyl sarcosinate, sodium cocoyl sarcosinate and sodium myristoyl sarcosinate are commercially available under the trademark HAMPOSYL ® by W. R. Grace & Co.-Conn., as 30% active solutions in water. To produce soap bars, much of the water is removed, which may require heating the solution to temperatures in the vicinity of 150° C.

Such sarcosinates are used, for example, in the skin cleansing compositions disclosed in U.S. Pat. No. 4,812,253. There it is disclosed that surfactants such as anionic acyl sarcosinates are present in the cleansing composition at a level of 20–70%, 20–50% in the case of soaps. In addition, sodium lauroyl sarcosinate is disclosed as being a preferred secondary surfactant together with sodium coco glyceryl sulfonate as a primary mild surfactant. The soap is disclosed as being made in situ from free fatty acids and a base selected from magnesium hydroxide, potassium hydroxide, sodium hydroxide and triethanolamine. Preferred fatty acids are mixtures of stearic and lauric acids having a ratio of from 2:1 to 1:1.

U.S. Pat. No. 4,754,874 to Haney discloses a transparent, mild, low pH soap bar and package therefor. The soap formulation disclosed includes sodium stearate and sodium cocoyl sarcosine, but no method of formulation is taught.

U.S. Pat. No. 4,954,282 to Rys et al. discloses skin cleansing compositions containing major amounts of acyl isethionates and at least one co-active surfactant, including sarcosinates.

SUMMARY OF THE INVENTION

The problems of the prior art have been solved by the instant invention, which provides a process for the production of a synthetic soap base with an easily adjustable pH. Surprisingly, it has been found that N-acyl sarcosine can be used as a solvent for a fatty acid. Accordingly, the instant process involves dissolving a fatty acid in the n-acyl sarcosine and neutralizing the acid mixture with caustic until the desired pH is obtained. By using sarcosine acid rather than the salt, no excess water needs to be eliminated, and easy processability, easy control of pH, and decreased production costs are realized. The resulting product, which can be shaped or formed into a bar, is non-irritating and non-drying, and exhibits apparent skin substantivity and pleasant skin feel.

DETAILED DESCRIPTION OF THE INVENTION

Fatty acids having carbon chain lengths from about $C_8$ to about $C_{18}$ are functional in the instant invention. Preferred fatty acid are stearic, myristic, palmitic and lauric acid, with stearic acid being especially preferred. For purposes of illustration, stearic acid will be referred to except where specified otherwise, although it should be understood that other fatty acid are within the scope of the instant invention.

Suitable n-acyl sarcosines in the instant invention include lauroyl sarcosine, cocoyl sarcosine, myristoyl sarcosine, oleoyl sarcosine and stearoyl sarcosine, with lauroyl sarcosine being preferred.

The instant method comprises dissolving the fatty acid in the n-acyl sarcosine that has been heated to a temperature of from about 50° C. to about 140° C., preferably about 50° C. to about 70° C., most preferably about 55° C., At temperatures below about 50° , the mixture tends to solidify. At temperatures greater than about 100° C., decomposition of the fatty acid tends to occur, although the acid dissolves faster in the sarcosine. Thus, if temperatures higher than about 100° C. are used, it is preferred that the temperature be quickly lowered upon dissolution. The acid mixture is then neutralized with alkali, such as sodium hydroxide, potassium hydroxide, isopropyl amine, monoethanol amine, etc., at a temperature sufficiently high to maintain fluidity of the neutralizing mix, until the desired pH is reached. The preferred alkali is a 50% solution of sodium hydroxide. Preferred temperatures for the neutralization are from about 60° C. to about 100° C., preferably about 70° C. The preferred pH is from about 4.5 to about 9.5, with a pH between about 5 and about 7 being especially preferred. A pH below about 4.5 is functional, but results in a bar that is very soft. A pH above about 9.5 deleteriously affects the foaming ability of the product. When the homogenous liquid is allowed to cool, it solidifies to a hard soap-like material which functions adequately as a soap but is mild, non-drying and produces a pleasant skin feel. The material can be easily molded as it cools but also may be remelted. This surprising characteristic will allow production of soap bars on a commercial scale by the conventional press molding technique.

Other surfactants may be added to the formulation, such as isethionates, especially acyl isethionates including sodium cocoyl isethionate. The acyl isethionates may render the soap bar brittle. In such a case, the brittleness can be controlled by the addition of amines, such as isopropyl amine. In addition, other conventional soap additives, including but not limited to glycerols or EDTA solutions may be dissolved in the heated liquid without materially affecting the processability of the system. It will be understood by those skilled in the art that other conventional additives, including perfumes, coloring agents, binders, skin feel and mildness aids, etc. may also be added.

The instant invention will be better understood by referring to the following specific but non-limiting examples. It is understood that said invention is not limited by these procedures which are offered merely as illustrations; it is also understood that modifications can be made without departing from the spirit and scope of the invention.

EXAMPLE 1

20 grams of N-cocoyl sarcosine was heated in a beaker to a temperature of about 55° C. on a stirrer hotplate. 20 grams of stearic acid flakes was added and quickly dissolved, producing a clear homogenous liquid at 55° C. The temperature was raised to about 80° C. and about 6 grams of 50% aqueous sodium hydroxide was added dropwise. The pH of the system was checked by dipping a few drops of the mix into deionized water, and was found to be approximately 6. The material solidified to a hard soaplike material on cooling and produced adequate foam with water.

EXAMPLE 2

20 grams of n-lauroyl sarcosine was heated to about 55° C., and 20 grams of stearic acid was added and quickly dissolved. The temperature was raised to about 80° C. and 20 grams of sodium cocoyl isethionate was dissolved and the system was neutralized with 5 grams of 50% aqueous sodium hydroxide. The pH of the aqueous solution was approximately 7. The material solidified to a hard soaplike material on cooling and exhibited improved flash foam over the material of Example 1.

(Alternatively, the sodium hydroxide may be added before the addition of the isethionate).

What is claimed is:

1. A method of producing synthetic detergent soap base consisting essentially of using, as the solvent, an N-acyl sarcosine selected from the group consisting of lauroyl sarcosine, cocoyl sarcosine, myristoyl sarcosine and oleoyl sarcosine, by dissolving a fatty acid in said solvent consisting of said N-acyl sarcosine at an elevated temperature and neutralizing the acid mixture with alkali at a temperature sufficient to maintain fluidity, to a pH of from about 4.5 to about 9.5.

2. The method of claim 1 wherein said acid mixture is neutralized to a pH of about 5 to about 7.

3. The method of claim 1 wherein said fatty acid is selected from the group consisting of lauric, myristic, palmitic and stearic acid.

4. The method of claim 1 wherein said fatty acid is stearic acid.

5. The method of claim 1 wherein said elevated temperature is from about 70° C. to about 100° C.

6. The method of claim 1 wherein said temperature sufficient to maintain fluidity is about 80° C.

7. The product formed by the method of claim 1.

* * * * *